US008611183B2

(12) United States Patent
Winkler et al.

(10) Patent No.: US 8,611,183 B2
(45) Date of Patent: Dec. 17, 2013

(54) MEASURING STANDOFF AND BOREHOLE GEOMETRY

(75) Inventors: Kenneth William Winkler, Ridgefield, CT (US); Lawrence E. McGowan, Bethel, CT (US); Ralph Michael D'Angelo, New Fairfield, CT (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1395 days.

(21) Appl. No.: 11/936,560

(22) Filed: Nov. 7, 2007

(65) Prior Publication Data

US 2009/0114472 A1 May 7, 2009

(51) Int. Cl.
*G01V 1/00* (2006.01)

(52) U.S. Cl.
USPC ..... 367/35; 367/27; 181/102; 702/6

(58) Field of Classification Search
USPC ..... 73/622, 12.01, 152.19, 152.58, 584, 73/597; 181/102, 103, 104, 108; 310/334, 310/336; 340/15.5; 364/422; 367/29, 31, 367/35, 86, 87, 151, 157, 180, 902, 911, 367/25–27, 34; 702/11
See application file for complete search history.

(56) References Cited

U.S. PATENT DOCUMENTS

| | | | | |
|---|---|---|---|---|
| 4,184,562 | A * | 1/1980 | Bakamjian | 181/107 |
| 4,701,891 | A * | 10/1987 | Castagna et al. | 367/31 |
| 4,827,457 | A * | 5/1989 | Seeman et al. | 367/27 |
| 4,845,616 | A | 7/1989 | Phillips | |
| 5,130,950 | A * | 7/1992 | Orban et al. | 367/34 |
| 5,341,345 | A | 8/1994 | Warner et al. | |
| 5,899,958 | A | 5/1999 | Dowell et al. | |
| 6,029,521 | A * | 2/2000 | Lin et al. | 73/597 |

(Continued)

FOREIGN PATENT DOCUMENTS

| | | |
|---|---|---|
| JP | 54149259 | 10/1979 |
| JP | 58164893 A | 9/1983 |
| JP | 60131484 A | 7/1985 |
| JP | 2078690 A1 | 6/1990 |

OTHER PUBLICATIONS

Birchak et al., "Standoff and Caliper Measurements While Drilling Using a New Formation-Evaluation Tool with Three Ultrasonic Transducers," SPE 26494, 68th Annual Technical Conference and Exhibition of the Society of Petroleum Engineers, Oct. 1993: pp. 793-805.

(Continued)

*Primary Examiner* — Isam Alsomiri
*Assistant Examiner* — Daniel L Murphy
(74) *Attorney, Agent, or Firm* — Jakub M. Michna; Rachel E. Greene; Bridget Laffey

(57) ABSTRACT

Refracted ultrasonic waves are utilized to calculate tool standoff. An ultrasonic transmitter sends a wave toward (and into) the borehole wall at a critical incidence angle for refracted waves. The refracted wave travels along the borehole wall and continuously radiates energy back into the borehole at the critical angle. The refracted wave is detected by a receiver, and the travel time of the refracted acoustic wave from transmitter to receiver is measured and used to calculate standoff. By making repeated measurements at various azimuths (for instance, as the tool rotates), one or more caliper measurements can be made. The caliper measurements can be combined to yield two-dimensional geometry of the borehole. Measurements made at different azimuths and depths yield three-dimensional borehole geometry. Arrays of transmitter-receiver pairs can be used to obviate the need for varying azimuth.

25 Claims, 4 Drawing Sheets

(56) References Cited

U.S. PATENT DOCUMENTS

| | | | | |
|---|---|---|---|---|
| 6,366,531 | B1 * | 4/2002 | Varsamis et al. | 367/26 |
| 6,483,777 | B1 | 11/2002 | Zeroug | |
| 6,678,616 | B1 | 1/2004 | Winkler et al. | |
| 7,149,146 | B2 | 12/2006 | Kuijk et al. | |
| 7,522,471 | B2 | 4/2009 | Froelich et al. | |
| 2006/0233048 | A1 | 10/2006 | Froelich et al. | |
| 2006/0262644 | A1 | 11/2006 | Schoepf et al. | |

OTHER PUBLICATIONS

International Search Report and Written Opinion of PCT Application Serial No. PCT/US2008/078051 dated Apr. 28, 2009.
Office Action of Japanese Application Serial No. 2010-501293 dated Jan. 17, 2012.

* cited by examiner

MEASURING STANDOFF AND BOREHOLE GEOMETRY

BACKGROUND OF THE INVENTION

1. Field of the Invention

The invention is generally related to the evaluation of subterranean formations, and more particularly to measuring standoff and borehole geometry.

2. Background of the Invention

Boreholes drilled in subterranean formations such as oilfields often have an irregular shape. In particular, the borehole wall is not perfectly smooth. The magnitude of irregularity may vary along the length of a given borehole, and be particularly great where the borehole traverses weak, highly stressed or fractured rock. Borehole shape (a.k.a., geometry) can provide an indication of the mechanical stability of the borehole, and can affect the reliability of some logging measurements. It is therefore useful to know borehole geometry.

It is known to use caliper measurements to evaluate the geometry of boreholes. On wireline tools, caliper measurements are local diameter measurements made either with mechanical arms or ultrasonic pulse/echoes. On logging-while-drilling tools, ultrasonic pulse/echoes are used. Caliper measurements can be combined to provide an indication of borehole geometry, i.e., two-dimensional or three-dimensional representations.

SUMMARY OF THE INVENTION

The present invention relates to an apparatus for subterranean formation evaluation in a borehole. The apparatus includes at least one transmitter operable to generate an acoustic wave that is refracted along a wall of the borehole. Further, the apparatus includes at least one receiver operable to receive the refracted wave. The apparatus includes processing circuitry operable to measure travel time of the acoustic wave from transmitter to receiver, and to calculate standoff from the wall based on the travel time. Finally, the apparatus includes memory operable to store the calculated standoff.

According to an aspect of the invention, the apparatus can include the processing circuitry to be operable to combine standoff calculations from different azimuths to generate data indicative of borehole geometry. Further, the processing circuitry can be operable to combine standoff calculations from different borehole depths to generate data indicative of borehole geometry.

According to an aspect of the invention, the apparatus can further comprise first and second transmitter-receiver pairs to be disposed on opposite sides of the apparatus, wherein first and second standoff measurements can be calculated with the first and second transmitter- receiver pairs, respectively. Further, the first and second standoff measurements can be calculated at a given azimuth and depth, wherein the measurements are combined with apparatus diameter to produce a caliper value. The apparatus can further comprise an array of transmitter-receiver pairs disposed on the apparatus, wherein borehole geometry measurements are calculated at a given azimuth over a range of depth.

According to an aspect of the invention, the apparatus can include the transmitter and receiver to be operable to measure formation velocity. It is possible the acoustic wave can be ultrasonic. Further, the apparatus can include the transmitter to send the wave into the borehole wall at a critical incidence angle for refracted waves. Further still, the apparatus may include a sensor operable to measure borehole fluid velocity. The apparatus may include a sensor operable to measure formation velocity.

In accordance with another embodiment of the invention, a method for subterranean formation evaluation in a borehole. The method can include transmitting an acoustic wave that is refracted along a wall of the borehole and receiving the refracted wave. Further, the method includes measuring travel time of the acoustic wave from transmission to receipt, calculating standoff based on the travel time, and storing the calculated standoff.

According to an aspect of the invention, the method can include the step of combining standoff calculations from different azimuths to generate data indicative of borehole geometry. It is possible the method may include the step of combining standoff calculations from different borehole depths to generate data indicative of borehole geometry. Further still, an apparatus used in practicing the method may comprise first and second transmitter-receiver pairs disposed on opposite sides of the apparatus. Wherein a further step can include calculating first and second standoff measurements with the first and second transmitter-receiver pairs, respectively, at a given azimuth and depth, and combining the measurements with the apparatus diameter to produce a caliper value. It is also possible that the apparatus further comprise an array of transmitter-receiver pairs disposed on the apparatus, the method including the step of calculating borehole geometry measurements at a given azimuth over a range of depth. The method can include the step of measuring formation velocity with the transmitter and receiver. Further, it is possible the acoustic wave can be ultrasonic. The method may include step of transmitting the wave into the borehole wall at a critical incidence angle for refracted waves. Further, the method may include the step of measuring borehole fluid velocity and/or measuring formation velocity.

In accordance with another embodiment of the invention, a device for producing formation data for evaluating subterranean formations. The device can include at least one transmitter connected to the device for transmitting an acoustic wave that is refracted along a wall of the borehole. Further, the device can include at least one receiver connected to the device for receiving the refracted wave from the borehole wall. Further still, the device can include a processor communicatively coupled to the at least one receiver, including means for producing formation data values from measured travel time of the acoustic wave from the at least one transmitter to the at least one receiver, so as to calculate a standoff value from the wall of the borehole to the device.

According to an aspect of the invention, the device can include first and second transmitter-receiver pairs disposed on opposite sides of the device, wherein first and second standoff measurements are calculated with the first and second transmitter-receiver pairs, respectively, at a given azimuth and depth, and wherein the measurements are combined with a device diameter to produce a caliper value. It is possible that the acoustic wave can be ultrasonic. Further, the apparatus may further comprise an array of transmitter-receiver pairs disposed on the device, wherein borehole geometry measurements can be calculated at a given azimuth over a range of depth. Further still, the transmitter may send the wave into the borehole wall at a critical incidence angle for refracted waves.

This technique may have an advantage over ultrasonic pulse-echo techniques in slow formations where it is easier to couple energy into a refracted wave than it is to generate a reflected wave. Pulse-echo techniques operate by measuring travel time of a reflected wave, i.e., a wave reflected by the formation at the borehole wall. However, in relatively soft formations relatively little of the transmitted energy is reflected. By transmitting the wave at (and into) the borehole wall at a critical incidence angle for refracted waves, and receiving the refracted wave at that angle, sufficient energy can be received to enable calculation of tool standoff even in relatively soft formations.

Further features and advantages of the invention will become more readily apparent from the following detailed description when taken in conjunction with the accompanying Drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice. Further, like reference numbers and designations in the various drawings indicated like elements.

The present invention is directed to an apparatus for subterranean formation evaluation in a borehole. The apparatus includes at least one transmitter operable to generate an acoustic wave that is refracted along a wall of the borehole. Further, the apparatus includes at least one receiver operable to receive the refracted wave. The apparatus includes processing circuitry operable to measure travel time of the acoustic wave from transmitter to receiver, and to calculate standoff based on the travel time. Finally, the apparatus includes memory operable to store the calculated standoff.

Figure 1:
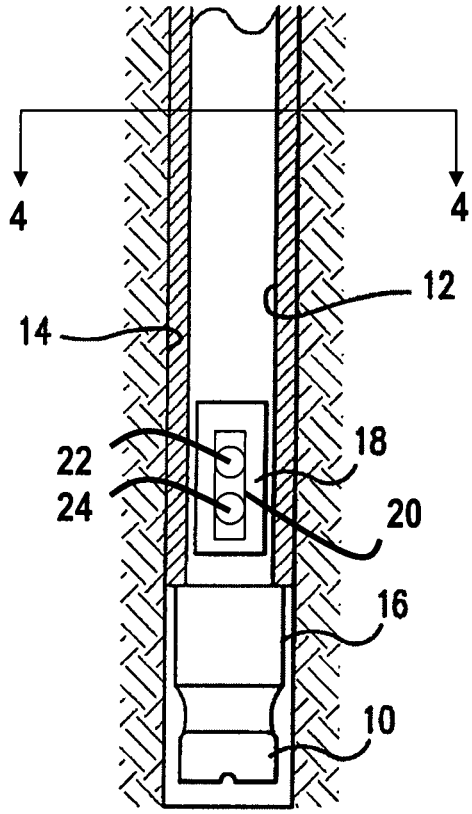
FIG. 1 illustrates a BHA with a LWD package including an ultrasonic formation evaluator according to an aspect of the invention.

FIG. 1 illustrates a Bottom Hole Assembly (BHA) adapted for use in Logging-While-Drilling (LWD) operations. The BHA includes a drill bit (10) attached to a length of drill collar (12) which forms the lower part of a drill string in a borehole (14). At least one stabilizer (16) is disposed on the drill collar (12) proximate to the drill bit (10). At least one logging-while-drilling package (18) is also disposed on the drill collar (12).

The LWD package (18) may include various sensors (not illustrated) for measuring properties related to drilling operations, such as torque and weight-on-bit, and for measuring properties related to formation evaluation, such as formation resistivity and density. The LWD package may also include power supplies, such as turbines driven by drilling mud flow, and batteries. Further, the LWD package includes data processing circuitry, memory, and a transceiver for communicating with a device at the surface for exchanging data and commands. The LWD package also has a microsonic formation evaluator (20) including at least one ultrasonic transmitter (22) and at least one ultrasonic receiver (24) for evaluating tool standoff, i.e., distance between the tool and the borehole wall.

The microsonic formation evaluator (20) utilizes ultrasonic waves refracted along the borehole wall to calculate the standoff (distance) of the tool from the borehole wall. The calculations make use of known tool geometry and measured mud velocity and rock velocity. Mud and rock velocity may be measured by a microsonic tool such as described in U.S. Pat. No. 6,678,616 entitled METHOD AND TOOL FOR PRODUCING A FORMATION VELOCITY IMAGE DATA SET, which is incorporated by reference. Wave propagation time from transmitter to receiver is measured using a clock circuit, and then inverted for the standoff using the known raypath. Calculated standoff values taken from opposing locations on the borehole circumference are used to calculate local caliper values (borehole diameters). Repeated caliper values of local borehole diameters at various azimuths (for instance, as the LWD tool rotates) and depths are combined to yield borehole shape (geometry). For example, a single transmitter-receiver pair can produce caliper values in a plane orthogonal to the axis of the borehole by rotating the tool, and borehole geometry can be obtained by rotating the tool and moving the tool through the borehole. Borehole shape data may be used to produce a three-dimensional borehole shape image.

Figure 2:
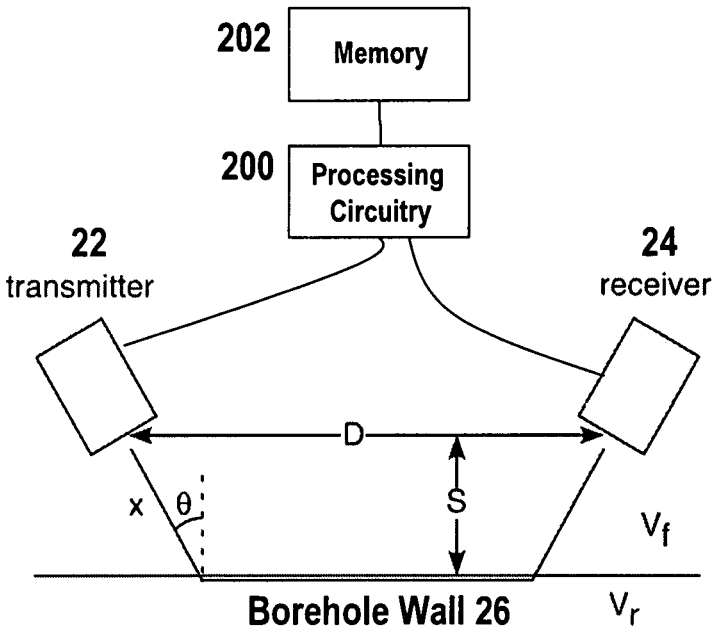
FIG. 2 is a schematic representation of the formation evaluator of FIG. 1.

Referring to FIGS. 1 and 2, under control of processing circuitry (200), the ultrasonic transmitter (22) sends a wave toward (and into) the borehole wall (26) at a critical incidence angle for refracted waves. A refracted wave travels along the borehole wall and continuously radiates energy back into the borehole at the critical angle. The acoustic transmitter (22) and receiver (24) both have standoff S and are separated by distance D. The fluid velocity $V_f$ and the rock velocity $V_r$ are both determined from measurement by any of various known techniques. These two velocities define the critical angle θ given by:

$$\theta = \sin^{-1}\left(\frac{V_f}{V_r}\right). \qquad \text{Eq. 1}$$

Total travel-time (T) from transmitter to receiver is given by the sum of two fluid paths and one rock path, which is measured by the processing circuitry (200).

$$T = \frac{2x}{V_f} + \frac{D - 2x\sin(\theta)}{V_r}. \qquad \text{Eq. 2}$$

Because cos(θ)=S/x, equation 2 can be rearranged to yield the standoff S:

$$S = \frac{T - \frac{D}{V_r}}{\frac{2}{V_f \cos(\theta)} - \frac{2\tan(\theta)}{V_r}}. \quad \text{Eq. 3}$$

The standoff measurement calculated by the processing circuitry (200) is stored in memory (202).

If the transmitter and receiver are not equidistant from the borehole wall, then corrections can be made for tool tilt. These corrections are described in U.S. Pat. No. 6,678,616.

Figure 3:
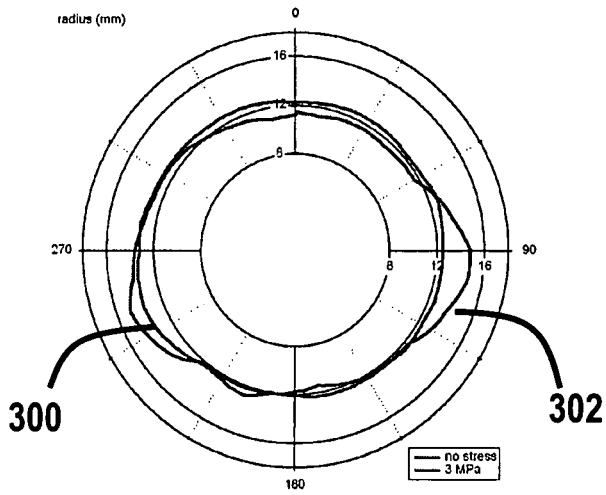
FIG. 3 illustrates a polar plot generated by the formation evaluator of FIG. 2.

FIG. 3 is a polar plot which illustrates cross-sectional borehole geometry in stressed shale measured using the invention. Curve (300) shows the initial borehole radius, i.e., drill bit radius. Curve (302) shows borehole geometry (at one cross-sectional location) with stress applied along the 0-180 degree direction. At higher stresses the borehole radius becomes shorter (compressed) along the direction in which stress is applied. The radius becomes elongated in a direction perpendicular to the stress. It will be appreciated that a three dimensional borehole shape image can be generated by a series of such single-location cross-sectional measurements.

Figure 4B:
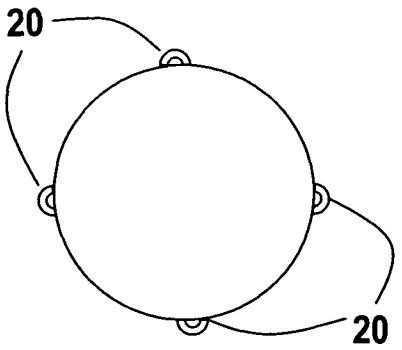
FIGS. 4*a* and 4*b* are alternative embodiments of the BHA of FIG. 1, depicted in cross-section 4-4.
Figure 4A:
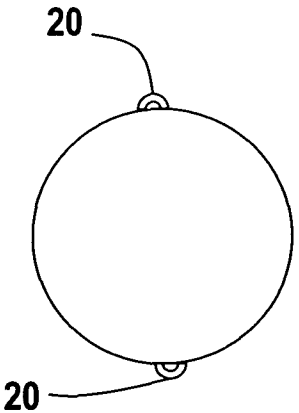

Referring now to FIGS. 4*a* and 4*b*, multiple evaluators (20) can be utilized to produce caliper values and borehole geometry. Where multiple evaluators are used, they may be disposed equidistantly around the circumference of a wireline tool body, e.g., two packages at opposite sides as depicted in FIG. 4*a*, four packages in quadrants as depicted in FIG. 4*b*, etc. A pair of evaluators (20) disposed on opposite sides of the tool enable calculation of a caliper value without rotational tool motion. An array of evaluators, e.g., in quadrants, enables calculation of borehole geometry where the tool is moved through the borehole without rotation. Those skilled in the art will appreciate that these embodiments could be utilized with rotational movement, and that a greater number of sensors might enhance results where the tool is not rotated. It should also be noted that the sensors described in U.S. Pat. No. 6,678,616 for measuring rock velocity could be adapted for use in tool standoff measurement.

While the invention is described through the above exemplary embodiments, it will be understood by those of ordinary skill in the art that modification to and variation of the illustrated embodiments may be made without departing from the inventive concepts herein disclosed. Moreover, while the preferred embodiments are described in connection with various illustrative structures, one skilled in the art will recognize that the system may be embodied using a variety of specific structures. Accordingly, the invention should not be viewed as limited except by the scope and spirit of the appended claims.

What is claimed is:

1. An apparatus, comprising:

at least one transmitter operable to generate an acoustic wave that is refracted along a wall of a borehole;

at least one receiver operable to receive the refracted acoustic wave;

processing circuitry operable to measure travel time of the refracted acoustic wave from transmitter to receiver, and to calculate standoff from the wall based on the travel time and formation velocity; and memory operable to store the calculated standoff.

2. The apparatus of claim 1, wherein the processing circuitry is further operable to combine standoff calculations from different azimuths to generate data indicative of borehole geometry.

3. The apparatus of claim 2, wherein the processing circuitry is further operable to combine standoff calculations from different borehole depths to generate data indicative of borehole geometry.

4. The apparatus of claim 1, further comprising first and second transmitter-receiver pairs disposed on opposite sides of the apparatus, and wherein first and second standoff measurements are calculated with the first and second transmitter-receiver pairs, respectively, at a given azimuth and depth, and wherein the measurements are combined with apparatus diameter to produce a caliper value.

5. The apparatus of claim 1, further comprising an array of transmitter-receiver pairs disposed on the apparatus, and wherein borehole geometry measurements are calculated at a given azimuth over a range of depth.

6. The apparatus of claim 1, wherein the transmitter and receiver are further operable to measure formation velocity.

7. The apparatus of claim 1, wherein the acoustic wave is ultrasonic.

8. The apparatus of claim 7, wherein the transmitter sends the wave into the borehole wall at a critical incidence angle for refracted waves.

9. The apparatus of claim 1, further including a sensor operable to measure borehole fluid velocity.

10. The apparatus of claim 1, further including a sensor operable to measure formation velocity.

11. A method comprising:

transmitting an acoustic wave that is refracted along a wall of a borehole;

receiving the refracted acoustic wave;

measuring travel time of the refracted acoustic wave from transmission to receipt;

calculating standoff from the wall based on the travel time and formation velocity; and storing the calculated standoff.

12. The method of claim 11, including the further step of combining standoff calculations from different azimuths to generate data indicative of borehole geometry.

13. The method of claim 12, including the further step of combining standoff calculations from different borehole depths to generate data indicative of borehole geometry.

14. The method of claim 11, further comprising first and second transmitter-receiver pairs disposed on opposite sides of an apparatus, and including the further step of calculating first and second standoff measurements with the first and second transmitter-receiver pairs, respectively, at a given azimuth and depth, and combining the measurements with apparatus diameter to produce a caliper value.

15. The method of claim 11, further comprising an array of transmitter-receiver pairs disposed on an apparatus, and including the further step of calculating borehole geometry measurements at a given azimuth over a range of depth.

16. The method of claim 11, including the further step of measuring formation velocity with the transmitter and receiver.

17. The method of claim 11, wherein the acoustic wave is ultrasonic.

18. The method of claim 17, including the further step of transmitting the wave into the borehole wall at a critical incidence angle for refracted waves.

19. The method of claim 11, including the further step of measuring borehole fluid velocity.

20. The method of claim 11, including the further step of measuring formation velocity.

21. A device for producing formation data for evaluating subterranean formations, the device comprising:

at least one transmitter connected to the device for transmitting an acoustic wave that is refracted along a wall of a borehole;

at least one receiver connected to the device for receiving the refracted acoustic wave from the borehole wall; and a processor communicatively coupled to the at least one receiver, including means for measuring travel time of the refracted acoustic wave from the at least one transmitter to the at least one receiver and determining formation velocity, so as to calculate a standoff value from the wall of the borehole to the device using the measured travel time and the formation velocity.

22. The device of claim 21, wherein the acoustic wave is ultrasonic.

23. The device of claim 21, further comprising a first and a second transmitter-receiver pairs disposed on opposite sides of the device, wherein first and second standoff measurements are calculated with the first and second transmitter-receiver pairs, respectively, at a given azimuth and depth, and wherein the measurements are combined with a device diameter to produce a caliper value.

24. The device of claim 21, further comprising an array of transmitter-receiver pairs disposed on the device, wherein borehole geometry measurements are calculated at a given azimuth over a range of depth.

25. The device of claim 24, wherein the transmitter sends the wave into the borehole wall at a critical incidence angle for refracted waves.

* * * * *